US007308793B2

(12) United States Patent
Oumejjoud et al.

(10) Patent No.: US 7,308,793 B2
(45) Date of Patent: Dec. 18, 2007

(54) APPARATUS AND METHOD FOR REDUCING CARBON MONOXIDE EMISSIONS

(75) Inventors: Khalid Oumejjoud, Palm Beach Gardens, FL (US); Peter Stuttaford, Jupiter, FL (US); Yan Chen, Palm Beach Gardens, FL (US); Nuria Margarit-Bel, Palm Beach Gardens, FL (US); Stephen Jennings, Palm City, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 493 days.

(21) Appl. No.: 10/905,497

(22) Filed: Jan. 7, 2005

(65) Prior Publication Data

US 2006/0150634 A1 Jul. 13, 2006

(51) Int. Cl.
*F23R 3/14* (2006.01)

(52) U.S. Cl. ..... 60/748; 60/776

(58) Field of Classification Search ..... 60/748, 60/776, 740, 742, 746, 737
See application file for complete search history.

(56) References Cited

U.S. PATENT DOCUMENTS

| | | | | |
|---|---|---|---|---|
| 3,938,324 | A | 2/1976 | Hammond, Jr. et al. | |
| 4,198,815 | A * | 4/1980 | Bobo et al. | 60/737 |
| 4,445,339 | A | 5/1984 | Davis, Jr. et al. | |
| 5,117,636 | A | 6/1992 | Bechtel, II et al. | |
| 5,117,637 | A * | 6/1992 | Howell et al. | 60/748 |
| 5,123,248 | A * | 6/1992 | Monty et al. | 60/740 |
| 5,203,796 | A | 4/1993 | Washam et al. | |
| 5,285,631 | A | 2/1994 | Bechtel, II et al. | |
| 5,319,935 | A * | 6/1994 | Toon et al. | 60/733 |
| 5,603,211 | A * | 2/1997 | Graves | 60/776 |
| 5,857,339 | A | 1/1999 | Roquemore et al. | |
| 5,987,889 | A * | 11/1999 | Graves et al. | 60/748 |
| 6,035,645 | A * | 3/2000 | Bensaadi et al. | 60/742 |
| 6,986,255 | B2 * | 1/2006 | Smith et al. | 60/776 |
| 7,065,972 | B2 * | 6/2006 | Zupanc et al. | 60/748 |
| 7,114,337 | B2 * | 10/2006 | Cazalens et al. | 60/737 |
| 7,137,256 | B1 * | 11/2006 | Stuttaford et al. | 60/773 |
| 2003/0172655 | A1 * | 9/2003 | Verdouw et al. | 60/737 |
| 2003/0196440 | A1 * | 10/2003 | Steinthorsson et al. | 60/776 |
| 2004/0065090 | A1 * | 4/2004 | Al-Roub et al. | 60/776 |
| 2005/0028526 | A1 * | 2/2005 | Von Der Bank | 60/748 |
| 2005/0241319 | A1 * | 11/2005 | Graves et al. | 60/776 |
| 2006/0059915 | A1 * | 3/2006 | Furletov et al. | 60/740 |
| 2006/0168966 | A1 * | 8/2006 | Stuttaford et al. | 60/772 |
| 2006/0248898 | A1 * | 11/2006 | Buelow et al. | 60/776 |

* cited by examiner

*Primary Examiner*—William H. Rodríguez
(74) *Attorney, Agent, or Firm*—Shook, Hardy & Bacon L.L.P.

(57) ABSTRACT

The present invention discloses an apparatus and method for reducing the carbon monoxide emissions emitted by a pilot injector of a gas turbine combustor. Multiple embodiments of a means for establishing a recirculation zone are disclosed whereby a portion of the fuel and air mixture from the pilot injector recirculates and a flame is held, thereby increasing the local reaction temperature at the desired location and lowering carbon monoxide emissions.

18 Claims, 8 Drawing Sheets

APPARATUS AND METHOD FOR REDUCING CARBON MONOXIDE EMISSIONS

BACKGROUND OF THE INVENTION

The present invention relates generally to gas turbine combustors and more specifically to an apparatus and method for reducing carbon monoxide emissions from gas turbine combustors.

In recent years government officials have passed more restrictive regulations regarding powerplant emissions, especially those for oxides of nitrogen (NOx) and carbon monoxide (CO). Each of these emissions are well known to contribute to air pollution and regulators continue to set lower levels of acceptable emissions. There are various means to comply with these lower emissions requirements, which vary depending on the powerplant location. Such means include passing the exhaust gases through a catalyst, which serves to transform the carbon monoxide and remaining hydrocarbons into water and carbon dioxide, utilizing lower flame temperature combustors, or limiting the amount of operating time of the powerplant. The latter is the most unfavorable option as it limits the amount of revenue that can be generated. However, the other technologies such as a catalyst and lower flame temperature combustors can be expensive as well.

Complying with environmental requirements is especially a concern when the powerplant is operating at a load point other than its preferred condition. Powerplants are designed to operate most efficiently at the "full-load" condition, that is when they are generating the most power possible, and it is at this condition that they are designed to produce the lowest emissions. However, there are many times when power demand is lower and it is more desirable to operate at a lower power setting, such that only the power demanded is actually supplied, thereby saving on fuel costs. It has been determined that when powerplants operate at conditions other than their most efficient, or design point, emission levels can go out of compliance with local regulations. This is especially true for NOx and CO and the present invention described herein addresses CO emissions reductions. Carbon monoxide from gas turbine combustion systems can typically be caused by a number of factors including inadequate burning rates, inadequate mixing of fuel and air prior to combustion, or quenching of the combustion products in surrounding cooling air. When combustion gases migrate towards a region containing cooler air, the temperature of this air, which is cooler than that of the hot combustion gases, prevents any further chemical reactions from occurring and CO will remain in the exhaust gases.

In order for powerplants to run at lower load conditions, where emission levels can be higher, it is necessary to be able to control the amount of emissions that will result when the combustion system is not operating at its preferred design point. A condition at which higher CO emissions are especially prevalent is at lower power settings. At these lower power settings, the combustion systems are operating at a lower fuel flow and often times burning in a different region than that of the full power condition that may not be as efficient. Therefore, in order to operate a powerplant with reduced CO emissions throughout its operating envelope, it is necessary for the combustion system to be able to provide adequate mixing such that the CO is not quenched and the combustion reactions are completed.

The present invention seeks to overcome the shortcomings of the prior art by providing an apparatus and method of reducing carbon monoxide emissions for a gas turbine combustion system.

SUMMARY OF THE INVENTION

The present invention discloses an apparatus and method for reducing the carbon monoxide emissions emitted by a pilot injector of a gas turbine combustor. The pilot injector provides the main flame source for igniting a fuel/air mixture in the combustor and at lower power settings is the only source of hot combustion gases necessary to drive the turbine. The preferred embodiment of the pilot injector comprises a radial swirler, at least one fuel injector, a passageway formed between first and second spaced walls, a means for establishing a recirculation area adjacent to the pilot injector, and a generally annular extension protruding into the combustor thereby providing a region for the CO to burnout prior to interacting with surrounding air flows and becoming quenched. It is in this recirculation area, of lower pressure, that the pilot flame will anchor and burn. As a result, the pilot flame is anchored separate from the main fuel air mixture, which would quench the reaction processing CO emissions from the pilot flame. Furthermore, the pilot flame is anchored further upstream so as to establish a greater residence time in which the pilot flame is to burn and complete the reactions to minimize CO formation.

DETAILED DESCRIPTION OF THE PREFERRED EMBODIMENT

Figure 1:
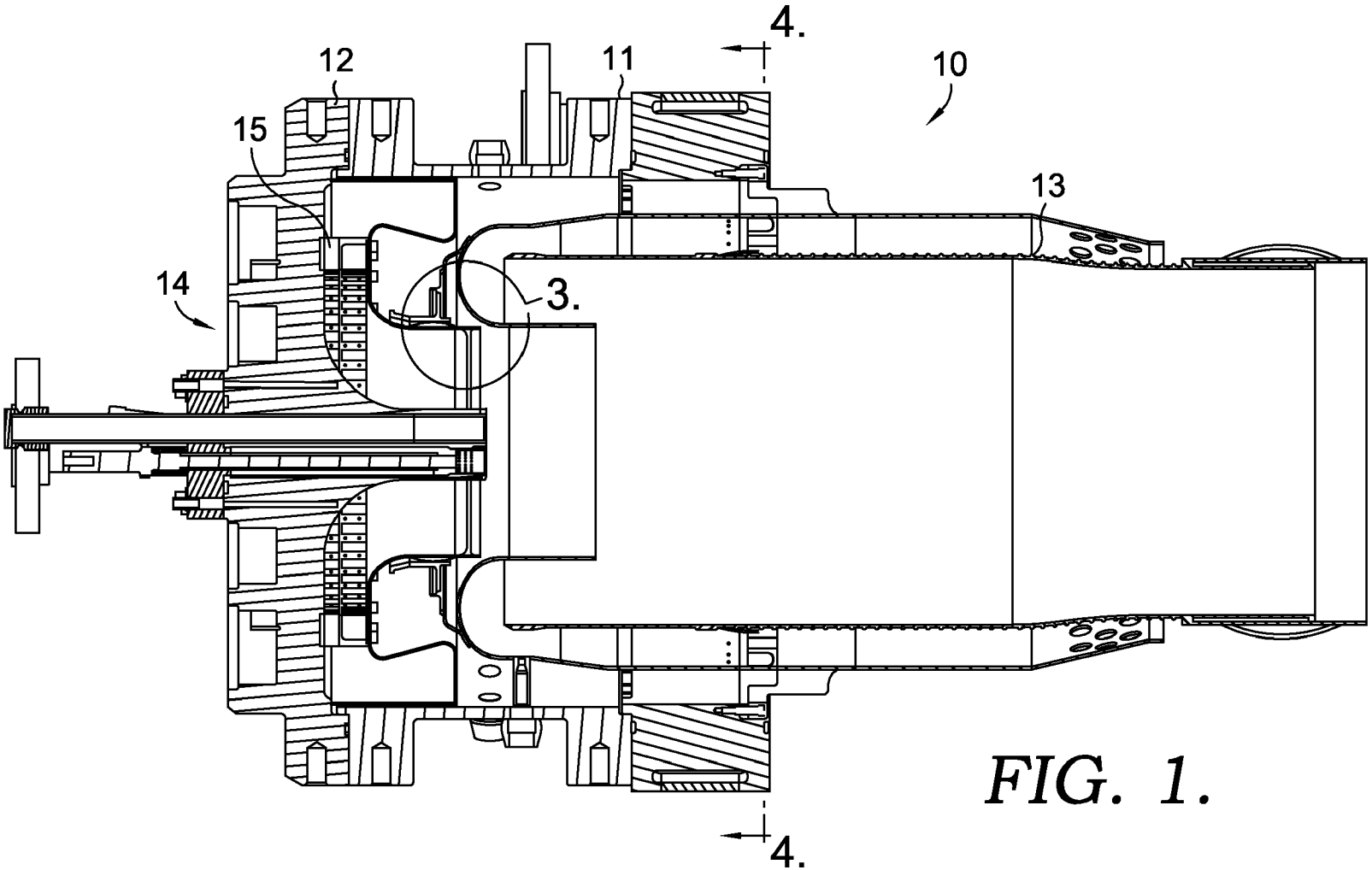
FIG. 1 is a cross section view of a combustor utilizing the present invention.
Figure 2:
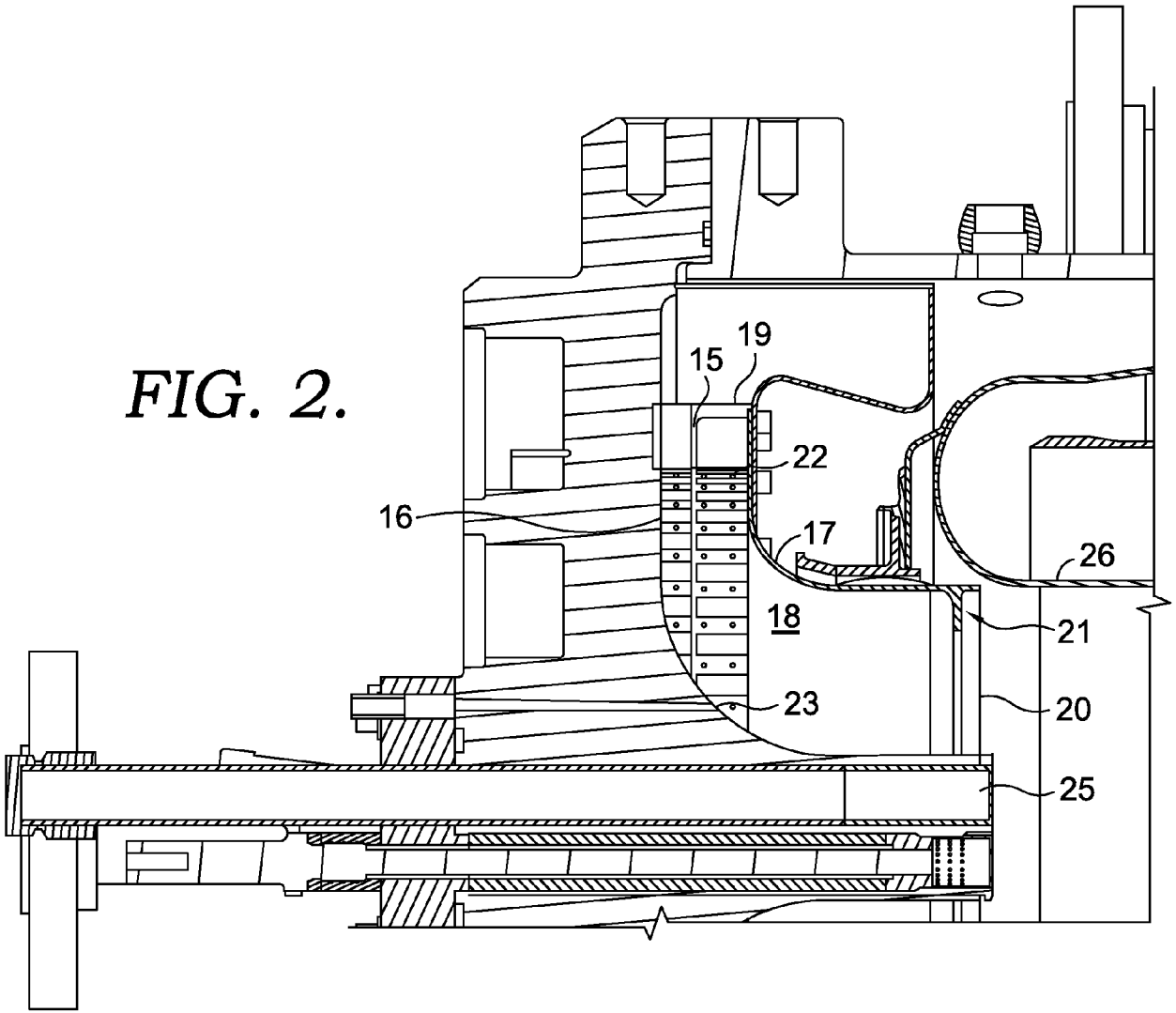
FIG. 2 is a detailed cross section of a portion of the combustor shown in FIG. 1 in accordance with the preferred embodiment of the present invention.

The present invention will now be described in detail with reference to FIGS. 1-8. Referring now to FIG. 1, a gas turbine combustor having a pilot injector in accordance with the present invention is shown in cross section. Combustor 10 comprises a casing 11, an end cover 12, a liner 13, and a pilot injector 14. The pilot injector is placed proximate the forward end of combustor 10 in order to provide the fuel source to establish a pilot flame in liner 13. Pilot injector 14, which is shown in greater detail in FIGS. 2 and 3, comprises a radial swirler 15, a first wall 16, and a second wall 17 in spaced relation such that a passageway 18 is formed therebetween. Passageway 18 has an inlet 19 and an outlet 20 and is oriented generally radially proximate inlet 19 and generally axially proximate outlet 20. Adjacent pilot injector 14, proximate outlet 20, but within passageway 18, is a means for establishing a recirculation area 21. Pilot injector 14 also comprises at least one fuel injector, but preferably a first injector 22 and a second injector 23, wherein first injector 22 is located proximate radial swirler 15. An additional feature of the present invention is generally annular extension 26, located proximate outlet 20 and extending into liner 13 a predetermined distance.

Figure 3:
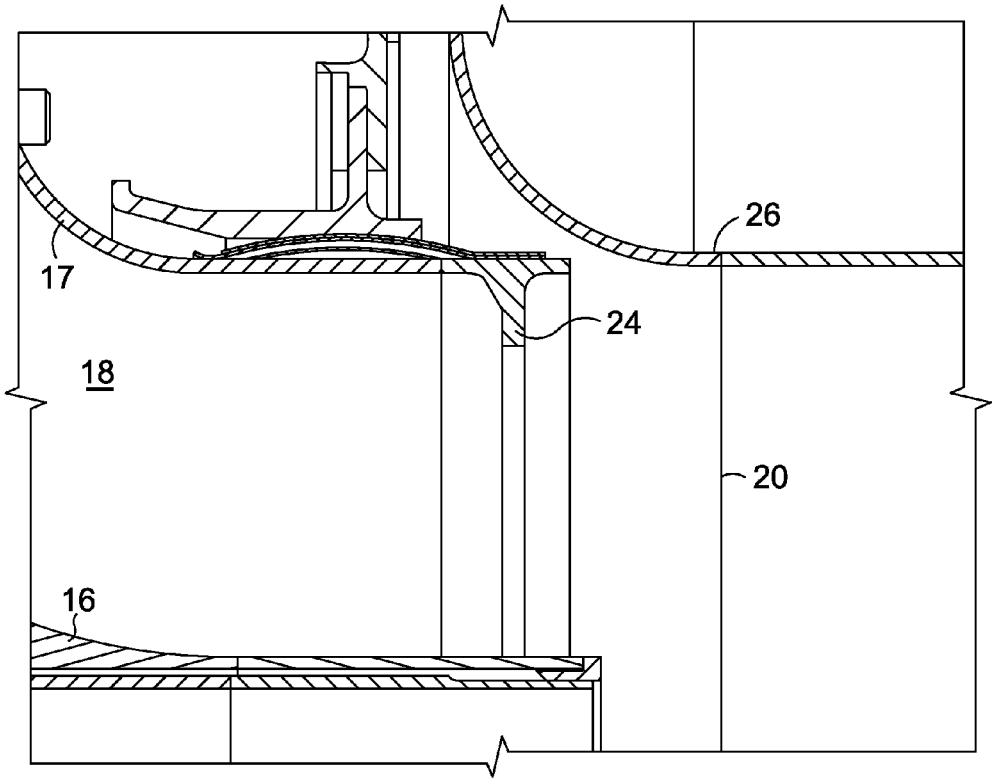
FIG. 3 is a further detailed cross section of a portion of the combustor shown in FIG. 2 in accordance with the preferred embodiment of the present invention.
Figure 4:
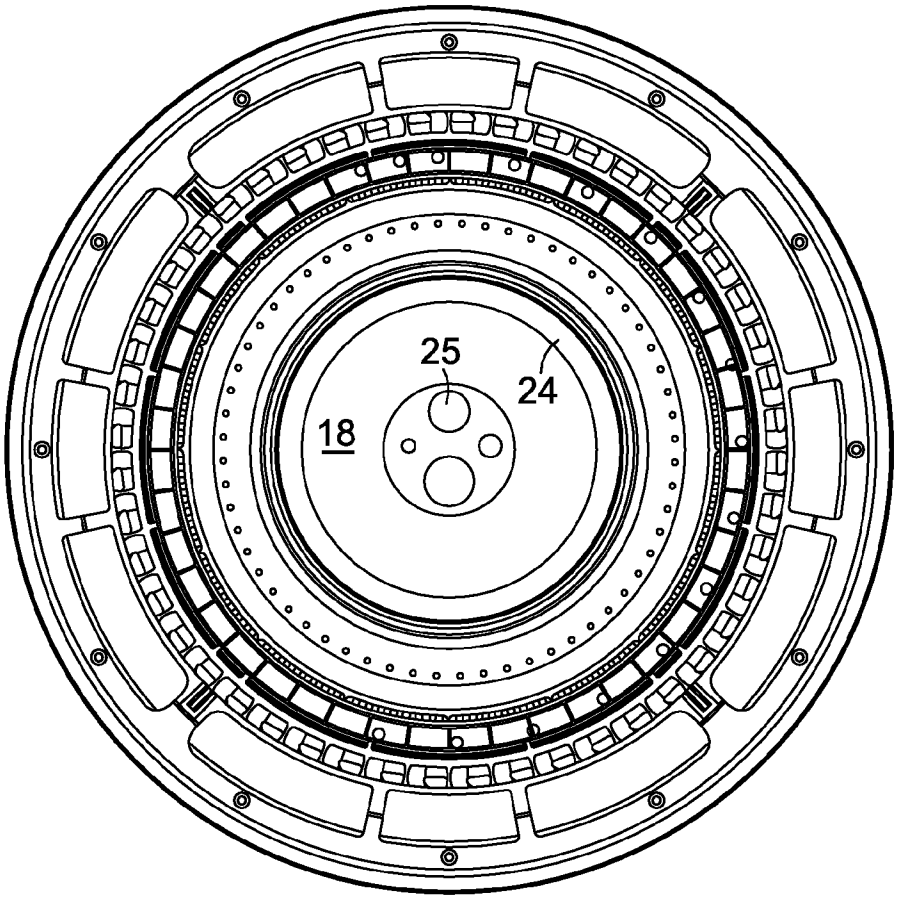
FIG. 4 is a section view taken from FIG. 1 looking axially upstream in accordance with the preferred embodiment of the present invention.

Referring to FIGS. 3 and 4, means for establishing a recirculation area 21 is shown in greater detail. In the preferred embodiment of the present invention, means for establishing a recirculation area 21 comprises an annular ring 24 that is positioned along second wall 17 proximate outlet 20 of passageway 18.

During typical gas turbine combustor operation, fuel and compressed air are mixed together and the premixture is then ignited to form hot combustion gases to drive a turbine. One measure of combustor, and engine, performance is emissions levels, and more specifically, carbon monoxide (CO) levels. One skilled in the art of gas turbine combustion will understand that CO formation is a multi-step process of breaking down the carbon molecules in the fuel. More specifically, high temperatures, concentrations of $O_2$, and large residence times are required for CO oxidation. However, this multi-step process can be interrupted by a quenching effect due to the combustor design. That is, the remaining oxygen atoms designed to react with the CO molecules to complete the reaction and form $CO_2$ are quenched or cooled prematurely. This typically occurs in regions where additional cooling air is mixed into the process. A means to ensure that this combustion process is completed, despite the addition of potential quenching effects, is to provide a mechanism for increasing the time in which CO is consumed. The present invention provides this mechanism.

In operation, air under pressure passes around the outside of liner 13 and is directed towards inlet 19. The air then passes through radial swirler 15 and mixes with a fuel from first injector 22. The fuel and air mixture is then directed through passageway 18 and towards outlet 20. Additional fuel may be provided from a second injector 23, as shown in the preferred embodiment in FIG. 2, where second injector 23 injects the fuel into passageway 18 in a direction that is generally perpendicular to first injector 22. Once the premixture exits passageway 18 it is ignited by an ignition system 25. For the preferred embodiment of the present invention, ignition system 25 is located generally along the centerline of combustor 10, but it can be placed wherever is most optimal for ignition purposes. However, proximate outlet 20, the fuel and air mixture encounters annular ring 24, which creates a recirculation zone at the outer diameter of the region directly downstream of passageway 18. This recirculation zone, which contains a low pressure region, holds the flame and raises the local reaction temperature. Without this recirculation zone, the flame at this region, and hence the local reaction temperature, was quenched. In addition to the recirculation zone established by annular ring 24, quenching is significantly reduced by the placement of generally annular extension 26 such that compressed air entering the combustor radially outward of extension 26 does not immediately interact with the flame from pilot injector 14. This separation provided by extension 26 allows sufficient time and distance for the CO to burnout of the reaction. Extensive rig testing and computational analysis has determined that the optimal axial length of generally annular extension 26 for the combustor of the present invention is approximately three inches. This axial distance provides the time necessary for the CO to burnout prior to interacting with the surrounding airflow radially outward of extension 26.

Figure 5:
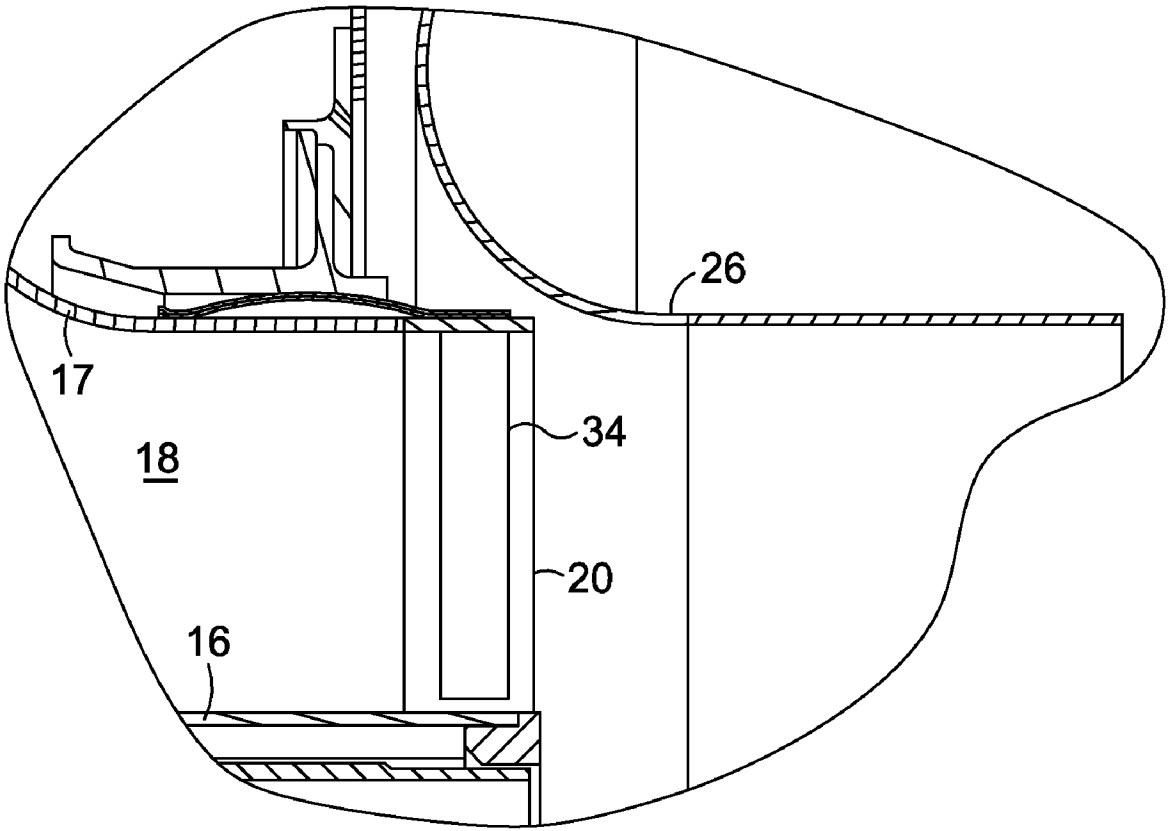
FIG. 5 is a detailed cross section of a portion of the combustor shown in FIG. 1 in accordance with a first alternate embodiment of the present invention.
Figure 6:
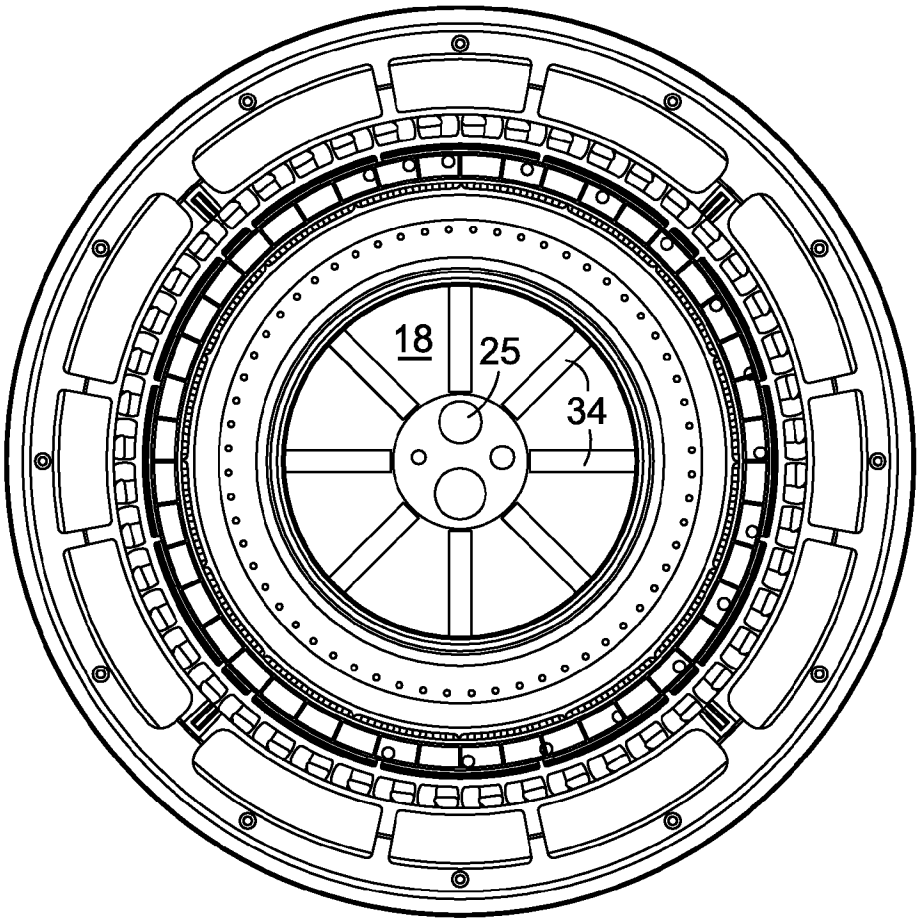
FIG. 6 is a section view taken from FIG. 1 looking axially upstream in accordance with a first alternate embodiment of the present invention.

A first alternate embodiment of the present invention is shown in FIGS. 5 and 6. A majority of the features of the first alternate embodiment are identical to those of the preferred embodiment. Therefore, only features unique to the first alternate embodiment will be discussed in further detail. Depending on the desired recirculation zone configuration, and resulting flame region, means for establishing a recirculation area can comprise a plurality of spokes 34 instead of an annular ring. In this first alternate embodiment, it is preferred that spokes 34 are positioned together in an axial plane along second wall 17 proximate outlet 20 of passageway 18 and extend from second wall 17 towards first wall 16. This can be seen in partial cross section in FIG. 5 and in full view looking axially upstream in FIG. 6. As a result of this configuration, a similar benefit regarding recirculation zone, local reaction temperature, and quenching is achieved, but the flame will develop radially along the whole length of the spoke as opposed to annularly behind the ring of the preferred embodiment.

Figure 7:
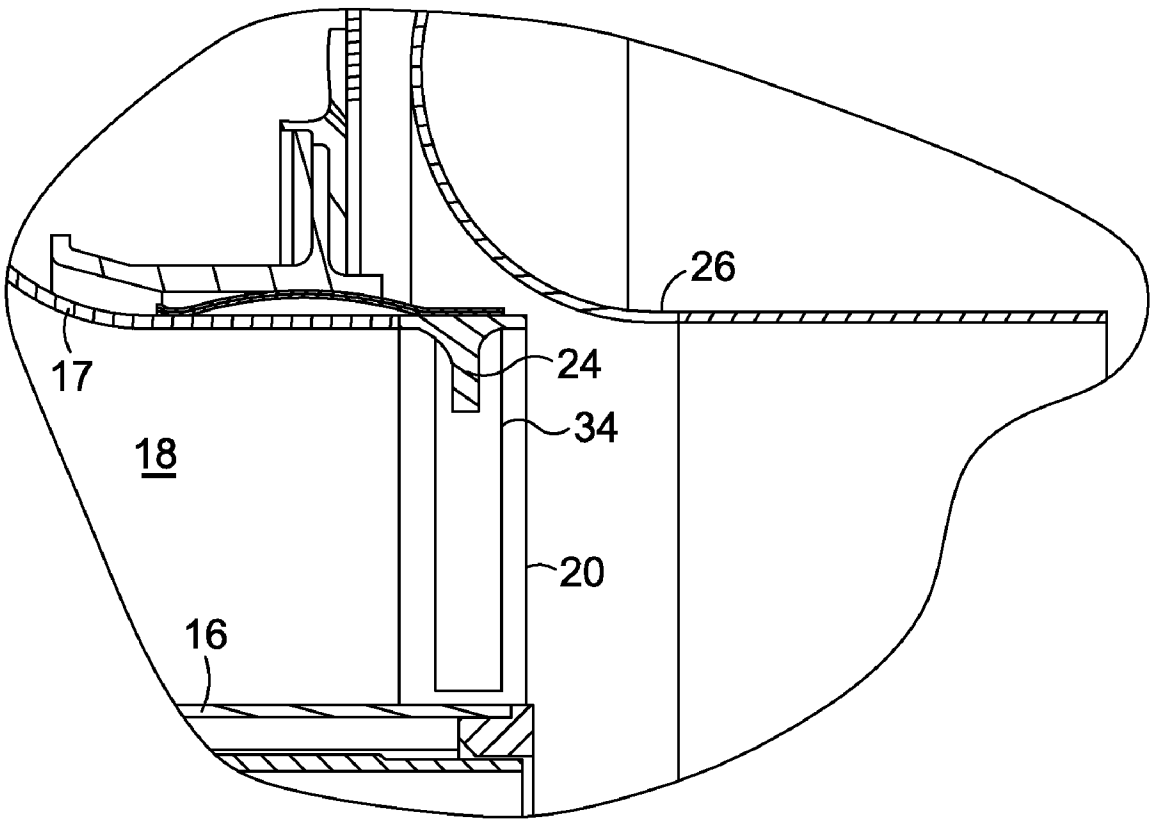
FIG. 7 is a detailed cross section of a portion of the combustor shown in FIG. 1 in accordance with a second alternate embodiment of the present invention.
Figure 8:
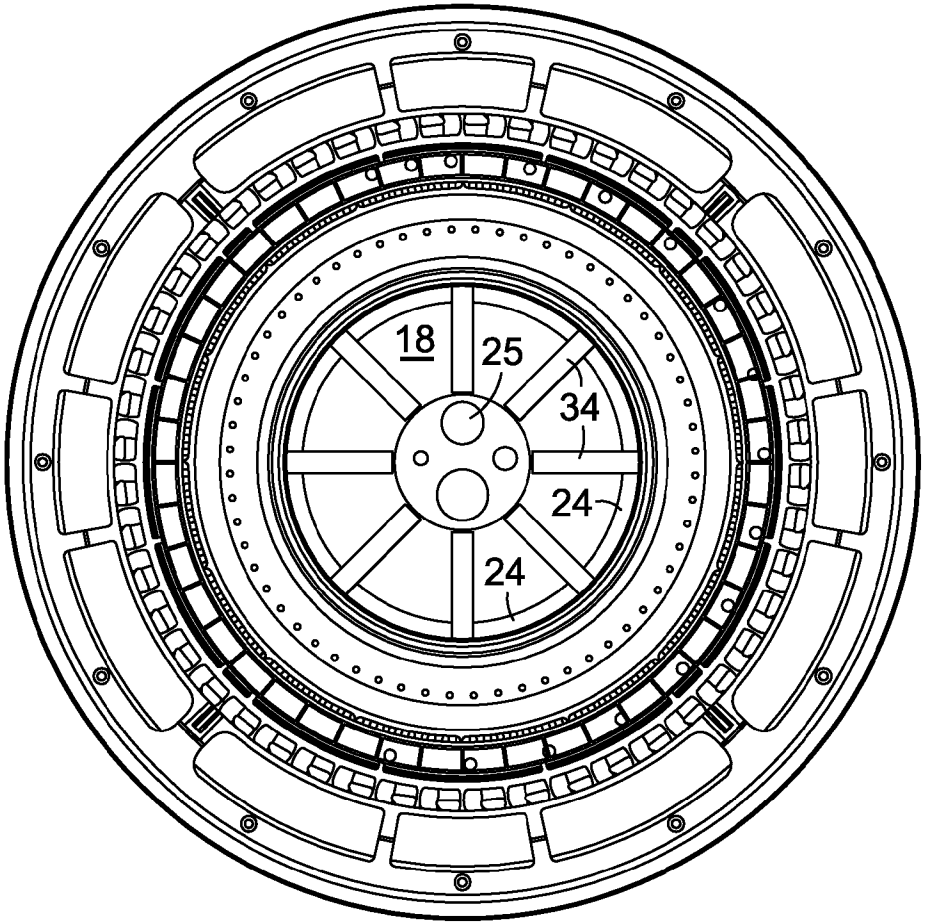
FIG. 8 is a section view taken from FIG. 1 looking axially upstream in accordance with a second alternate embodiment of the present invention.

A second alternate embodiment of the present invention is shown in FIGS. 7 and 8. A majority of the features of the second alternate embodiment are identical to those of the preferred embodiment as well. Therefore, only features unique to the second alternate embodiment will be discussed in further detail. As with the first alternate embodiment, the means for establishing a recirculation area can be positioned in yet another configuration. In the second alternate embodiment, the means for establishing a recirculation area is a combination of annular ring 24 of the preferred embodiment as well as plurality of spokes 34 from the first alternate embodiment. This combination is shown in partial cross section in FIG. 7 and looking axially upstream in FIG. 8. In this configuration, a plurality of spokes 34 are positioned together in an axial plane along second wall 17 proximate outlet 20 of passageway 18 and extend from second wall 17 towards first wall 16. In between spokes 34 are sections of annular ring 24. This configuration will allow the flame to anchor on the outer diameter of passageway 18 proximate annular ring 24 as well as along spokes 34, due to the multiple recirculation zones formed by ring 24 and spokes 34, thus increasing the local reaction temperature and lowering CO emissions.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What is claimed is:

1. A pilot injector for a gas turbine combustor that reduces the amount of carbon monoxide emissions produced by said combustor, said pilot injector comprising:

A radial swirler;

At least one fuel injector;

A first wall and second wall in spaced relation thereby forming a passageway therebetween, said passageway having an inlet and an outlet;

A means for establishing a recirculation area adjacent said pilot injector wherein said means for establishing a recirculation area is located within said passageway, proximate said outlet; and, A generally annular extension located proximate said outlet and extending in an axial direction into a combustion liner.

2. The pilot injector of claim 1 wherein said at least one injector comprises a first injector and a second injector.

3. The pilot injector of claim 2 wherein said first injector is located proximate said radial swirler.

4. The pilot injector of claim 2 wherein said second injector injects a fuel into said passageway in a direction that is generally perpendicular to said first injector.

5. The pilot injector of claim 1 wherein said passageway is oriented generally radially proximate said inlet and generally axially proximate said outlet.

6. The pilot injector of claim 1 wherein said means for establishing a recirculation area comprises an annular ring.

7. The pilot injector of claim 6 wherein said annular ring is positioned along said second wall proximate said outlet of said passageway.

8. The pilot injector of claim 1 wherein said means for establishing a recirculation area comprises a plurality of spokes.

9. The pilot injector of claim 8 wherein said plurality of spokes are positioned together in an axial plane along said second wall proximate said outlet of said passageway, and extend from said second wall towards said first wall.

10. The pilot injector of claim 1 wherein said means for establishing a recirculation area comprises an annular ring and a plurality of spokes.

11. The pilot injector of claim 10 wherein said annular ring and plurality of spokes are coplanar and positioned along said second wall proximate said outlet of said passageway, and extend from said second wall towards said first wall.

12. A method of reducing the amount of carbon monoxide emissions produced by a gas turbine combustor at low power settings, said method comprising the steps:

Providing a pilot injector comprising a radial swirler, at least one fuel injector, a first wall and second wall in spaced relation thereby forming a passageway therebetween, said passageway having an inlet and an outlet, a means for establishing a recirculation area adjacent said pilot injector wherein said means for establishing a recirculation area is located within said passageway, proximate said outlet, and a generally annular extension located proximate said outlet and extending in an axial direction into a combustion liner;

Flowing a fuel through said at least one fuel injector to mix with an air supply in said passageway to form a premixture;

Directing said premixture through said passageway and across said means for establishing a recirculation area, such that a low pressure region is created and said premixture circulates in said low pressure region; and, Burning said premixture along said low pressure region at a higher local reaction temperature, due to the reduced quenching affect by air on the reaction, thereby reducing carbon monoxide emissions.

13. The method of claim 12 wherein said means for establishing a recirculation area comprises an annular ring.

14. The method of claim 13 wherein said annular ring is positioned along said second wall proximate said outlet of said passageway.

15. The method of claim 12 wherein said means for establishing a recirculation area comprises a plurality of spokes.

16. The method of claim 15 wherein said plurality of spokes are positioned together in an axial plane along said second wall proximate said outlet of said passageway, and extend from said second wall towards said first wall.

17. The method of claim 12 wherein said means for establishing a recirculation area comprises an annular ring and a plurality of spokes.

18. The method of claim 17 wherein said annular ring and plurality of spokes are coplanar and positioned along said second wall proximate said outlet of said passageway, and extend from said second wall towards said first wall.

* * * * *